US010147434B2

(12) United States Patent
Hashimoto et al.

(10) Patent No.: US 10,147,434 B2
(45) Date of Patent: Dec. 4, 2018

(54) SIGNAL PROCESSING DEVICE AND SIGNAL PROCESSING METHOD

(71) Applicant: CLARION CO., LTD., Saitama (JP)

(72) Inventors: Takeshi Hashimoto, Motomiya (JP); Tetsuo Watanabe, Hasuda (JP); Yasuhiro Fujita, Kashiwa (JP); Kazutomo Fukue, Saitama (JP)

(73) Assignee: CLARION CO., LTD., Saitama (JP)

( * ) Notice: Subject to any disclaimer, the term of this patent is extended or adjusted under 35 U.S.C. 154(b) by 0 days.

(21) Appl. No.: 14/894,579

(22) PCT Filed: May 26, 2014

(86) PCT No.: PCT/JP2014/063789

§ 371 (c)(1),
(2) Date: Nov. 30, 2015

(87) PCT Pub. No.: WO2014/192675

PCT Pub. Date: Dec. 4, 2014

(65) Prior Publication Data

US 2016/0104499 A1 Apr. 14, 2016

(30) Foreign Application Priority Data

May 31, 2013 (JP) ..... 2013-116004

(51) Int. Cl.
*G10L 19/02* (2013.01)
*G10L 19/032* (2013.01)
(Continued)

(52) U.S. Cl.
CPC ..... *G10L 19/0204* (2013.01); *G10L 19/032* (2013.01); *G10L 21/0388* (2013.01); *G10L 25/18* (2013.01)

(58) Field of Classification Search
CPC ..... G10L 19/0204; G10L 19/032; G10L 21/038; G10L 21/0388; G10L 21/0232; G10L 21/0332; G10L 25/18
(Continued)

(56) References Cited

U.S. PATENT DOCUMENTS 5,596,658 A * 1/1997 Levy ..... G06K 9/00523 348/384.1
2002/0103637 A1 8/2002 Henn et al.
(Continued)

FOREIGN PATENT DOCUMENTS

CN 1475010 A 2/2004
CN 101273404 A 9/2008
(Continued)

OTHER PUBLICATIONS

International Search Report of PCT/JP2014/063789.
(Continued)

*Primary Examiner* — Yogeshkumar Patel
(74) *Attorney, Agent, or Firm* — McCarter & English, LLP

(57) ABSTRACT

A signal processing device comprises: a band detecting means for detecting a frequency band which satisfies a predetermined condition from an audio signal; a reference signal generating means for generating a reference signal in accordance with a detection band by the band detecting means; a reference signal correcting means for correcting the generated reference signal on the basis of a frequency characteristic thereof; a frequency band extending means for extending the corrected reference signal up to a frequency band higher than the detection band; an interpolation signal generating means for generating an interpolation signal by weighting each frequency component within the extended frequency band in accordance with a frequency character-
(Continued)

istic of the audio signal; and a signal synthesizing means for synthesizing the generated interpolation signal with the audio signal.

18 Claims, 8 Drawing Sheets

(51) Int. Cl.
*G10L 21/0388* (2013.01)
*G10L 25/18* (2013.01)

(58) Field of Classification Search
USPC ..... 704/94, 203, 205, 500; 370/343
See application file for complete search history.

(56) References Cited

U.S. PATENT DOCUMENTS

2003/0093278 A1* 5/2003 Malah ..... G10L 21/038 704/265
2003/0093279 A1* 5/2003 Malah ..... G10L 21/038 704/265
2003/0125889 A1* 7/2003 Sato ..... G10L 19/02 702/75
2003/0130848 A1* 7/2003 Sheikhzadeh-Nadjar ..... G10L 13/10 704/260
2004/0002856 A1* 1/2004 Bhaskar ..... G10L 19/097 704/219
2004/0098431 A1* 5/2004 Sato ..... G10L 21/038 708/290
2005/0043830 A1* 2/2005 Lee ..... G10L 19/018 700/94
2007/0090027 A1 4/2007 Haselberger et al.
2007/0293960 A1* 12/2007 Fujii ..... G10L 19/0204 700/94
2008/0046233 A1* 2/2008 Chen ..... G10L 19/005 704/211
2008/0129350 A1* 6/2008 Mitsufuji ..... G10L 21/038 327/113
2008/0294429 A1* 11/2008 Su ..... G10L 19/09 704/222
2009/0157413 A1 6/2009 Oshikiri
2009/0259476 A1 10/2009 Sato
2010/0013987 A1* 1/2010 Edler ..... G10L 19/0204 348/425.2
2010/0217584 A1* 8/2010 Hirose ..... G10L 21/0208 704/206
2010/0222907 A1* 9/2010 Hashimoto ..... G10L 21/038 700/94
2010/0228557 A1* 9/2010 Chen ..... G10L 19/24 704/500
2011/0058686 A1* 3/2011 Toraichi ..... B60D 1/58 381/98
2011/0081029 A1* 4/2011 Hashimoto ..... H03G 9/025 381/107
2011/0099004 A1* 4/2011 Krishnan ..... G10L 21/038 704/206
2011/0106547 A1* 5/2011 Toraichi ..... G10L 19/0208 704/501
2011/0125505 A1* 5/2011 Vaillancourt ..... G10L 19/005 704/500
2011/0137659 A1* 6/2011 Honma ..... G10L 21/038 704/500
2011/0282675 A1* 11/2011 Nagel ..... G10L 19/24 704/500
2011/0302230 A1* 12/2011 Ekstrand ..... H03H 17/0266 708/201
2012/0010879 A1* 1/2012 Tsujino ..... G10L 19/06 704/203
2012/0010880 A1 1/2012 Nagel et al.
2012/0016667 A1* 1/2012 Gao ..... G10L 21/038 704/203
2012/0051549 A1* 3/2012 Nagel ..... G10L 19/025 381/56
2012/0065983 A1* 3/2012 Ekstrand ..... G10L 21/038 704/500
2012/0170646 A1* 7/2012 Baylon ..... H04N 19/619 375/240.02
2012/0209597 A1* 8/2012 Yamanashi ..... G10L 19/0204 704/205
2012/0243526 A1* 9/2012 Yamamoto ..... G10L 21/0388 370/343
2012/0328124 A1* 12/2012 Kjoerling ..... G10L 21/038 381/98
2013/0028427 A1* 1/2013 Yamamoto ..... G10L 21/038 381/22
2013/0030818 A1* 1/2013 Yamamoto ..... G10L 19/0204 704/500
2013/0041673 A1 2/2013 Nagel et al.
2013/0090933 A1* 4/2013 Villemoes ..... G10L 19/0204 704/500
2013/0151262 A1* 6/2013 Lohwasser ..... G10L 19/16 704/500
2013/0202118 A1* 8/2013 Yamamoto ..... G10L 19/008 381/22
2013/0208902 A1* 8/2013 Yamamoto ..... G10L 19/008 381/22
2014/0064403 A1* 3/2014 Woodsum ..... H04L 27/2601 375/295
2014/0214413 A1* 7/2014 Atti ..... G10L 19/26 704/219
2015/0010170 A1* 1/2015 Lindahl ..... H03H 17/0261 381/119
2016/0035365 A1* 2/2016 Kamano ..... G10L 19/02 704/500
2016/0189718 A1* 6/2016 Davis ..... G10L 19/008 704/501
2016/0329062 A1* 11/2016 Ekstrand ..... G10L 19/265

FOREIGN PATENT DOCUMENTS

CN 101868823 A 10/2010
CN 102027537 A 4/2011
CN 102177545 A 9/2011
CN 102598123 A 7/2012
CN 103026408 A 4/2013
EP 2209116 7/2010
JP 2004-514180 5/2004
JP 2007-25480 2/2007
JP 2007-534478 11/2007
JP 2008/058470 * 3/2008
JP 2008-58470 3/2008
JP 2008/058470 A * 3/2008
JP 2012-504781 2/2012
WO 2009054393 4/2009
WO 2011048820 4/2011

OTHER PUBLICATIONS

International Preliminary Report on Patentability of PCT/JP2014/063789 dated Dec. 10, 2015.
Extended European Search Report issued in Application No. 14804912.5 dated Feb. 3, 2017.
Notification of Reasons for Rejection issued in Japanese Application No. 2013-116004 dated Jul. 21, 2017 with English translation.
Office Action dated Jun. 8, 2018, in Chinese Application No. 201480031036.4, along with English translation thereof (11 pages).

* cited by examiner

SIGNAL PROCESSING DEVICE AND SIGNAL PROCESSING METHOD

This application is a National Phase Application of PCT International Application No.: PCT/JP2014/063789, filed on May 26, 2014.

TECHNICAL FIELD

The present invention relates to a signal processing device and a signal processing method for interpolating high frequency components of an audio signal by generating an interpolation signal and synthesizing the interpolation signal with the audio signal.

BACKGROUND ART

As formats for compression of audio signals, nonreversible compression formats such as MP3 (MPEG Audio Layer-3), WMA (Windows Media Audio, registered trademark), and AAC (Advanced Audio Coding) are known. In the nonreversible compression formats, high compression rates are achieved by drastically cutting high frequency components that are near or exceed the upper limit of the audible range. At the time when this type of technique was developed, it was thought that auditory sound quality degradation does not occur even when high frequency components are drastically cut. However, in recent years, a thought that drastically cutting high frequency components slightly changes sound quality and degrades auditory sound quality is becoming the mainstream. Therefore, high frequency interpolation devices that improve sound quality by performing high frequency interpolation on the nonreversibly compressed audio signals have been proposed. Specific configurations of this type of high frequency interpolation devices are disclosed for example in Japanese Patent Provisional Publication No. 2007-25480A (hereinafter, Patent Document 1) and in Re-publication of Japanese Patent Application No. 2007-534478 (hereinafter, Patent Document 2).

A high frequency interpolation device disclosed in Patent Document 1 calculates a real part and an imaginary part of a signal obtained by analyzing an audio signal (raw signal), forms an envelope component of the raw signal using the calculated real part and imaginary part, and extracts a high-harmonic component of the formed envelope component. The high frequency interpolation device disclosed in Patent Document 1 performs the high frequency interpolation on the raw signal by synthesizing the extracted high-harmonic component with the raw signal.

A high frequency interpolation device disclosed in Patent Document 2 inverses a spectrum of an audio signal, up-samples the signal of which the spectrum is inverted, and extracts an extension band component of which a lower frequency end is almost the same as a high frequency range of the baseband signal from the up-sampled signal. The high frequency interpolation device disclosed in Patent Document 2 performs the high frequency interpolation of the baseband signal by synthesizing the extracted extension band component with the baseband signal.

SUMMARY OF THE INVENTION

A frequency band of a nonreversibly compressed audio signal changes in accordance with a compression encoding format, a sampling rate, and a bit rate after compression encoding. Therefore, if the high frequency interpolation is performed by synthesizing an interpolation signal of a fixed frequency band with an audio signal as disclosed in Patent Document 1, a frequency spectrum of the audio signal after the high frequency interpolation becomes discontinuous, depending on the frequency band of the audio signal before the high frequency interpolation. Thus, performing the high frequency interpolation on audio signals using the high frequency interpolation device disclosed in Patent Document 1 may have an adverse effect of degrading auditory sound quality.

Furthermore, as a general characteristic, attenuation of a level of an audio signal is greater at higher frequencies, but there is a case where a level of an audio signal instantaneously amplifies at the high frequency side. However, in Patent Document 2, only the former general characteristic is taken into account as characteristics of audio signals to be inputted to the device. Therefore, immediately after an audio signal of which a level amplifies at the high frequency side is inputted, a frequency spectrum of the audio signal becomes discontinuous, and a high frequency region is excessively emphasized. Thus, as with the high frequency interpolation device disclosed in Patent Document 1, performing the high frequency interpolation on audio signals using the high frequency interpolation device disclosed in Patent Document 2 may have an adverse effect of degrading auditory sound quality.

The present invention is made in view of the above circumstances, and the object of the present invention is to provide a signal processing device and a signal processing method that are capable of achieving sound quality improvement by the high frequency interpolation regardless of frequency characteristics of nonreversibly compressed audio signals.

One aspect of the present invention provides a signal processing device comprising a band detecting means for detecting a frequency band which satisfies a predetermined condition from an audio signal; a reference signal generating means for generating a reference signal in accordance with a detection band by the band detecting means; a reference signal correcting means for correcting the generated reference signal on a basis of a frequency characteristic of the generated reference signal; a frequency band extending means for extending the corrected reference signal up to a frequency band higher than the detection band; an interpolation signal generating means for generating an interpolation signal by weighting each frequency component within the extended frequency band in accordance with a frequency characteristic of the audio signal; and a signal synthesizing means for synthesizing the generated interpolation signal with the audio signal.

According to the above configuration, since the reference signal is corrected with a value in accordance with a frequency characteristic of an audio signal and the interpolation signal is generated on the basis of the corrected reference signal and synthesized with the audio signal, sound quality improvement by the high frequency interpolation is achieved regardless of a frequency characteristic of an audio signal.

For example, the reference signal correcting means corrects the reference signal generated by the reference signal generating means to a flat frequency characteristic.

Also, the reference signal correcting means may be configured to perform a second regression analysis on the reference signal generated by the reference signal generating means; calculate a reference signal weighting value for each frequency of the reference signal on a basis of frequency characteristic information obtained by the second regression analysis; and correct the reference signal by multiplying the calculated reference signal weighting value for each frequency and the reference signal together.

For example, the reference signal generating means extracts a range that is within n % of the overall detection band at a high frequency side and sets the extracted components as the reference signal.

The band detecting means may be configured to calculate levels of the audio signal in a first frequency range and a second frequency range being higher than the first frequency range; set a threshold on a basis of the calculated levels in the first and second frequency ranges; and detect the frequency band from the audio signal on the basis of the set threshold.

Also, for example, the band detecting means detects, from the audio signal, a frequency band of which an upper frequency limit is a highest frequency point among at least one frequency point where the level falls below the threshold.

The interpolation signal generating means may be configured to perform a first regression analysis on at least a portion of the audio signal; calculate an interpolation signal weighting value for each frequency component within the extended frequency band on a basis of frequency characteristic information obtained by the first regression analysis; and generate the interpolation signal by multiplying the calculated interpolation signal weighting value for each frequency component and each frequency component within the extended frequency band together.

For example, the frequency characteristic information obtained by the first regression analysis includes a rate of change of the frequency components within the extended frequency band. In this case, the interpolation signal generating means increases the interpolation signal weighting values as the rate of change gets greater in a minus direction.

Also, for example, the interpolation signal generating means decreases the interpolation signal weighting value as an upper frequency limit of a range for the first regression analysis gets higher.

Also, when at least one of following conditions (1) to (3) is satisfied, the signal processing device may be configured not to perform generation of the interpolation signal by the interpolation signal generating means:

(1) the detected amplitude spectrum Sa is equal to or less than a predetermined frequency range;

(2) the signal level at the second frequency range is equal to or more than a predetermined value; or (3) a signal level difference between the first frequency range and the second frequency range is equal to or less than a predetermined value.

Another aspect of the present invention provides a signal processing method comprising a band detecting step of detecting a frequency band which satisfies a predetermined condition from an audio signal; a reference signal generating step of generating a reference signal in accordance with a detection band detected by the band detecting means; a reference signal correcting step of correcting the generated reference signal on a basis of a frequency characteristic of the generated reference signal; a frequency band extending step of extending the corrected reference signal up to a frequency band higher than the detection band; an interpolation signal generating step of generating an interpolation signal by weighting each frequency component within the extended frequency band in accordance with a frequency characteristic of the audio signal; and a signal synthesizing step of synthesizing the generated interpolation signal with the audio signal.

According to the above configuration, since the reference signal is corrected with a value in accordance with a frequency characteristic of an audio signal and the interpolation signal is generated on the basis of the corrected reference signal and synthesized with the audio signal, sound quality improvement by the high frequency interpolation is achieved regardless of a frequency characteristic of an audio signal.

For example, in the reference signal correcting step, the reference signal generated by the reference signal generating means may be corrected to a flat frequency characteristic.

In the reference signal correcting step, a second regression analysis may be performed on the reference signal generated by the reference signal generating means; a reference signal weighting value may be calculated for each frequency of the reference signal on a basis of frequency characteristic information obtained by the second regression analysis; and the reference signal may be corrected by multiplying the calculated reference signal weighting value for each frequency of the reference signal and the reference signal together.

In the reference signal generating step, a range that is within n % of the overall detection band at a high frequency side may be extracted, and the extracted components may be set as the reference signal.

In the band detecting step, levels of the audio signal in a first frequency range and a second frequency range being higher in frequency than the first frequency range may be calculated; a threshold may be set on a basis of the calculated levels in the first and second frequency ranges; and the frequency band may be detected from the audio signal on a basis of the set threshold.

In the band detecting step, a frequency band of which an upper frequency limit is a highest frequency point among at least one frequency point where the level falls below the threshold may be detected from the audio signal.

In the interpolation signal generating step, a first regression analysis may be performed on at least a portion of the audio signal; an interpolation signal weighting value may be calculated for each frequency component within the extended frequency band on a basis of frequency characteristic information obtained by the first regression analysis; and the interpolation signal may be generated by multiplying the calculated interpolation signal weighting value for each frequency component and each frequency component within the extended frequency band together.

The frequency characteristic information obtained by the first regression analysis includes a rate of change of the frequency components within the extended frequency band, and in the interpolation signal generating step, the interpolation signal weighting value may be increased as the rate of change gets greater in a minus direction.

In the interpolation signal generating step, the interpolation signal weighting value may be decreased as an upper frequency limit of a range for the first regression analysis gets higher.

When at least one of following conditions (1) to (3) is satisfied, the signal processing method may be configured not to generate interpolation signal in the interpolation signal generating step:

(1) the detected amplitude spectrum Sa is equal to or less than a predetermined frequency range;

(2) the signal level at the second frequency range is equal to or more than a predetermined value; or (3) a signal level difference between the first frequency range and the second frequency range is equal to or less than a predetermined value.

EMBODIMENTS FOR CARRYING OUT THE INVENTION

Hereinafter, a sound processing device according to an embodiment of the present invention will be described with reference to the accompanying drawings.

[Overall Configuration of Sound Processing Device 1]

Figure 1:
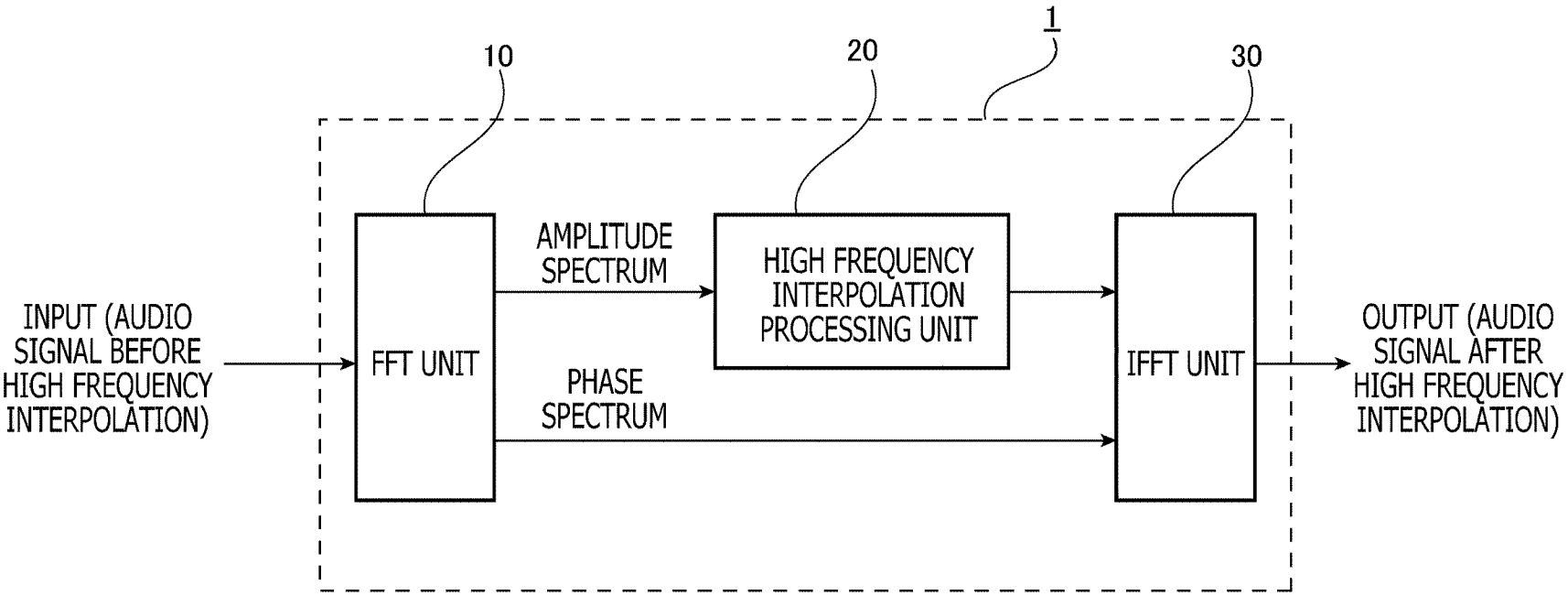
FIG. 1 is a block diagram showing a configuration of a sound processing device of an embodiment of the present invention.

FIG. 1 is a block diagram showing a configuration of a sound processing device 1 of the present embodiment. As shown in FIG. 1, the sound processing device 1 comprises an FFT (Fast Fourier Transform) unit 10, a high frequency interpolation processing unit 20, and an IFFT (Inverse FFT) unit 30.

To the FFT unit 10, an audio signal which is generated by a sound source by decoding an encoded signal in a nonreversible compressing format is inputted from the sound source. The nonreversible compressing format is MP3, WMA, AAC or the like. The FFT unit 10 performs an overlapping process and weighting by a window function on the inputted audio signal, and then converts the weighted signal from the time domain to the frequency domain using STFT (Short-Term Fourier Transform) to obtain a real part frequency spectrum and an imaginary part frequency spectrum. The FFT unit 10 converts the frequency spectrums obtained by the frequency conversion to an amplitude spectrum and a phase spectrum. The FFT unit 10 outputs the amplitude spectrum to the high frequency interpolation processing unit 20 and the phase spectrum to the IFFT unit 30. The high frequency interpolation processing unit 20 interpolates a high frequency region of the amplitude spectrum inputted from the FFT unit 10 and outputs the interpolated amplitude spectrum to the IFFT unit 30. A band that is interpolated by the high frequency interpolation processing unit 20 is, for example, a high frequency band near or exceeding the upper limit of the audible range, drastically cut by the nonreversible compression. The IFFT unit 30 calculates real part frequency spectra and imaginary part frequency spectra on the basis of the amplitude spectrum of which the high frequency region is interpolated by the high frequency interpolation processing circuit 20 and the phase spectrum which is outputted from the FFT unit 10 and held as it is, and performs weighting using a window function. The IFFT unit 30 converts the weighted signal from the frequency domain to the time domain using STFT and overlap addition, and generates and outputs the audio signal of which the high frequency region is interpolated.

[Configuration of High Frequency Interpolation Processing Unit 20]

Figure 2:
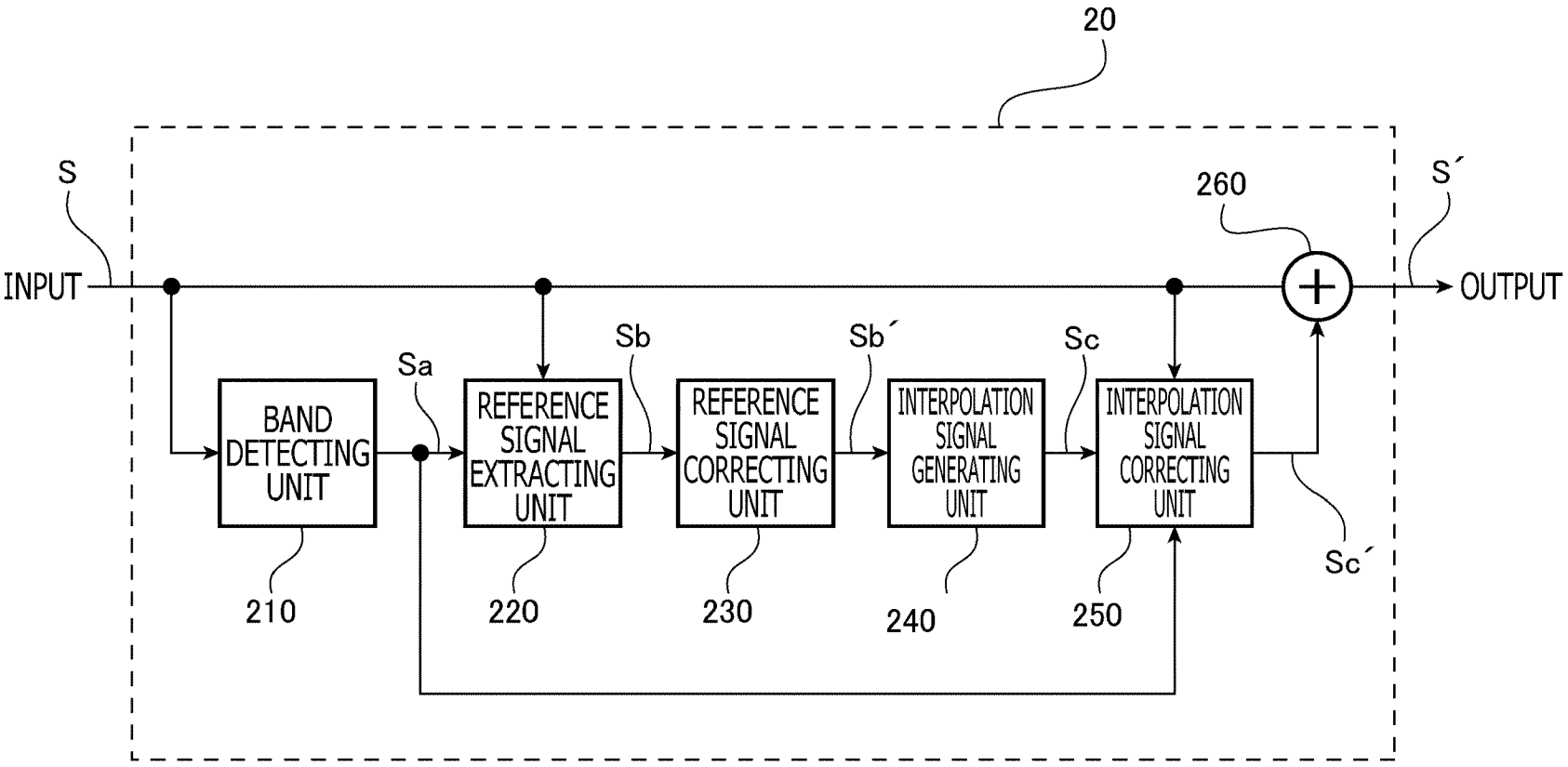
FIG. 2 is a block chart showing a configuration of a high frequency interpolation processing unit provided to the sound processing device of the embodiment of the present invention.

FIG. 2 is a block diagram showing a configuration of the high frequency interpolation processing unit 20. As shown in FIG. 2, the high frequency interpolation processing unit 20 comprises a band detecting unit 210, a reference signal extracting unit 220, a reference signal correcting unit 230, an interpolation signal generating unit 240, an interpolation signal correcting unit 250, and an adding unit 260. It is noted that each of input signals and output signals to and from each of the units in the high frequency interpolation processing unit 20 is followed by a symbol for convenience of explanation.

Figure 3:
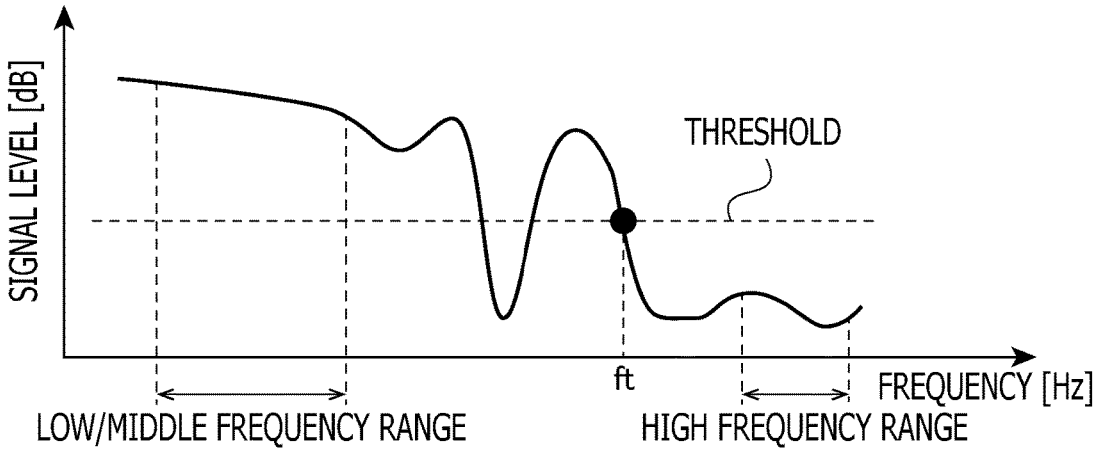
FIG. 3 is an auxiliary diagram for assisting explanation of a behavior of a band detecting unit provided to the high frequency interpolation processing unit of the embodiment of the present invention.

FIG. 3 is a diagram for assisting explanation of a behavior of the band detecting unit 210, and shows an example of an amplitude spectrum S to be inputted to the band detecting unit 210 from the FFT unit 10. In FIG. 3, the vertical axis (y axis) is signal level (unit: dB), and the horizontal axis (x axis) is frequency (unit: Hz).

The band detecting unit 210 converts the amplitude spectrum S (linear scale) of the audio signal inputted from the FFT unit 10 to the decibel scale. The band detecting unit 210 calculates signal levels of the amplitude spectrum S, converted to the decibel scale, within a predetermined low/middle frequency range and a predetermined high frequency range, and sets a threshold on the basis of the calculated signal levels within the low/middle frequency range and the high frequency range. For example, as shown in FIG. 3, the threshold is at a midlevel of the signal level within the low/middle frequency range (average value) and the signal level within the high frequency range (average value).

The band detecting unit 210 detects an audio signal (amplitude spectrum Sa), having a frequency band of which the upper frequency limit is a frequency point where the signal level falls below the threshold, from the amplitude spectrum S (linear scale) inputted from the FFT unit 10. If there are a plurality of frequency points where the signal level falls below the threshold as shown in FIG. 3, the amplitude spectrum Sa, having a frequency band of which the upper frequency limit is the highest frequency point (in the example shown in FIG. 3, frequency ft), is detected. The band detecting unit 210 smooths the detected amplitude spectrum Sa by smoothing to suppress local dispersions included in the amplitude spectrum Sa. It is noted that it is judged that generation of interpolation signal is not necessary if at least one of the following conditions (1)-(3) is satisfied, to suppress unnecessary interpolation signal generation.

(1) The detected amplitude spectrum Sa is equal to or less than a predetermined frequency range.

(2) The signal level at the high frequency range is equal to or more than a predetermined value.

(3) A signal level difference between the low/middle frequency range and the high frequency range is equal to or less than a predetermined value.

The high frequency interpolation is not performed on amplitude spectra which are judged that the generation of the interpolation signal is not necessary.

FIG. 4A-FIG. 4H show operating waveform diagrams for explanation of a series of processes up to the high frequency interpolation using the amplitude spectrum Sa detected by the band detecting unit 210. In each of FIG. 4A-FIG. 4H, the vertical axis (y axis) is signal level (unit: dB), and the horizontal axis (x axis) is frequency (unit: Hz).

To the reference signal extracting unit 220, the amplitude spectrum Sa detected by the band detecting unit 210 is inputted. The reference signal extracting unit 220 extracts a reference signal Sb from the amplitude spectrum Sa in accordance with the frequency band of the amplitude spectrum Sa (see FIG. 4A). For example, an amplitude spectrum that is within a range of n % ($0<n$) of the overall amplitude spectrum Sa at the high frequency side is extracted as the reference spectrum Sb. It is noted that there is a problem that interpolating an audio signal using an interpolation signal generated from a voice band (e.g., a natural voice) degrades sound quality of the audio signal to the one that is likely to give uncomfortable auditory feeling. In contrast, in the above example, since a frequency band of the reference signal Sb becomes narrower as the frequency band of the reference signal Sa gets narrower, extraction of the voice band that causes degradation of sound quality can be suppressed.

The reference signal extracting unit 220 shifts the frequency of the reference signal Sb extracted from the amplitude spectrum Sa to the low frequency side (DC side) (see FIG. 4B), and outputs the frequency shifted reference signal Sb to the reference signal correcting unit 230.

The reference signal correcting unit 230 converts the reference signal Sb (linear scale) inputted from the reference signal extracting unit 220 to the decibel scale, and detects a frequency slope of the decibel scale converted reference signal Sb using linear regression analysis. The reference signal correcting unit 230 calculates an inverse characteristic of the frequency slope (a weighting value for each frequency of the reference signal Sb) detected using the linear regression analysis. Specifically, when the weighting value for each frequency of the reference signal Sb is defined as $P_1(x)$, an FFT sample position in the frequency domain on the horizontal axis (x axis) is defined as x, a value of the frequency slope of the reference signal Sb detected using the linear regression analysis is defined as $\alpha_1$, and ½ of the number of FFT samples corresponding to a frequency band of the reference signal Sb is defined as $\beta_1$, the reference signal correcting unit 230 calculates the inverse characteristic of the frequency slope (the weighting value $P_1(x)$ for each frequency of the reference signal Sb) using the following expression (1).

$$P_1(x)=-\alpha_1 x+\beta_1 \quad \text{[EXPRESSION 1]}$$

Figures 4A, 4B, 4C, 4D:
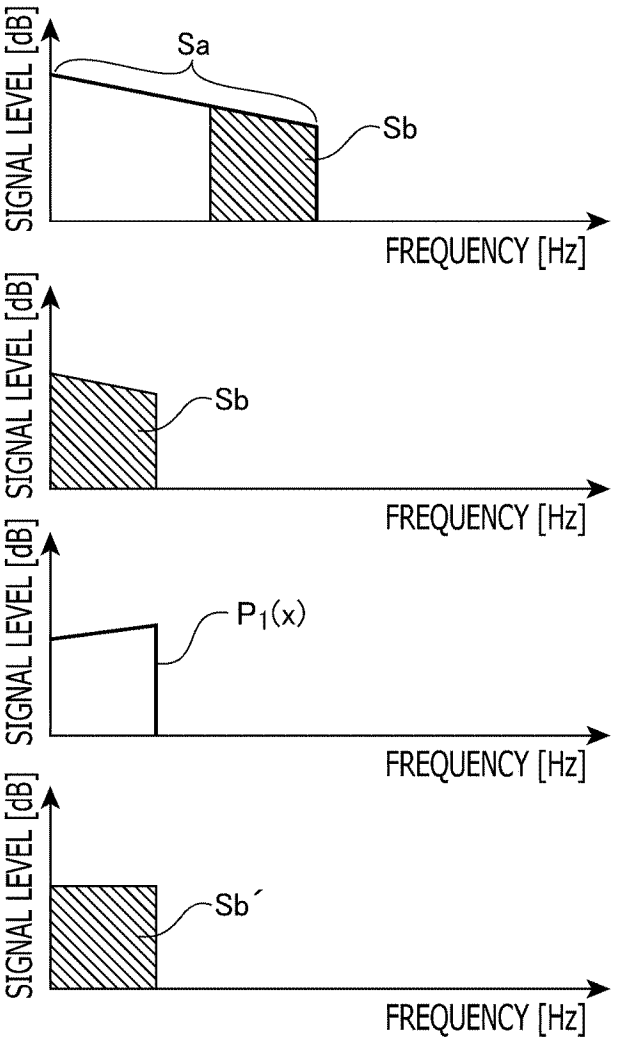
FIG. 4 shows operating waveform diagrams for explanation of a series of processes until a high frequency interpolation is performed using an amplitude spectrum detected by the band detecting unit of the embodiment of the present invention.

As shown in FIG. 4C, the weighting value $P_1(x)$ calculated for each frequency of the reference signal Sb is in the decibel scale. The reference signal correcting unit 230 converts the weighting value $P_1(x)$ in the decibel scale to the linear scale. The reference signal correcting unit 230 corrects the reference signal Sb by multiplying the weighting value $P_1(x)$ converted to the linear scale and the reference signal Sb (linear scale) inputted from the reference signal extracting unit 220 together. Specifically, the reference signal Sb is corrected to a signal (reference signal Sb') having a flat frequency characteristic (see FIG. 4D).

To the interpolation signal generating unit 240, the reference signal Sb' corrected by the reference signal correcting unit 230 is inputted. The interpolation signal generating unit 240 generates an interpolation signal Sc that includes a high frequency region by extending the reference signal Sb' up to a frequency band that is higher than that of the amplitude spectrum Sa (see FIG. 4E) (in other words, the reference signal Sb' is duplicated until the duplicated signal reaches a frequency band that is higher than that of the amplitude spectrum Sa). The interpolation signal Sc has a flat frequency characteristic. Also, for example, the extended range of the Reference signal Sb' includes the overall frequency band of the amplitude spectrum Sa and a frequency band that is within a predetermined range higher than the frequency band of the amplitude spectrum Sa (a band that is near the upper limit of the audible range, a band that exceeds the upper limit of the audible range or the like).

To the interpolation signal correcting unit 250, the interpolation signal Sc generated by the interpolation signal generating unit 240 is inputted. The interpolation signal correcting unit 250 converts the amplitude spectrum S (linear scale) inputted from the FFT unit 10 to the decibel scale, and detects a frequency slope of the amplitude spectrum S converted to the decibel scale using linear regression analysis. It is noted that, in place of detecting the frequency slope of the amplitude spectrum S, a frequency slope of the amplitude spectrum Sa inputted from the band detecting unit 210 may be detected. A range of the regression analysis may be arbitrarily set, but typically, the range of the regression analysis is a range corresponding to a predetermined frequency band that does not include low frequency components to smoothly join the high frequency side of the audio signal and the interpolation signal. The interpolation signal correcting unit 250 calculates a weighting value for each frequency on the basis of the detected frequency slope and the frequency band corresponding to the range of the regression analysis. Specifically, when the weighting value for the interpolation signal Sc at each frequency is defined as $P_2(x)$, the FFT sample position in the frequency domain on the horizontal axis (x axis) is defined as x, an upper frequency limit of the range of the regression analysis is defined as b, a sample length for the FFT is defined as s, a slope in a frequency band corresponding to the range of the regression analysis is defined as $\alpha_2$, and a predetermined correction coefficient is defined as k, the interpolation signal correcting unit 250 calculates the weighting value $P_2(x)$ for the interpolation signal Sc at each frequency using the following expression (2).

$$P_2(x)=-\alpha' x+\beta_2 \quad \text{[EXPRESSION 2]}$$

where $$\alpha'=\alpha_2[1-(b/s)]/k$$

$$\beta_2=-\alpha' b$$

when $x<b$, $P_2(x)=-\infty$

Figures 4E, 4F, 4G, 4H:
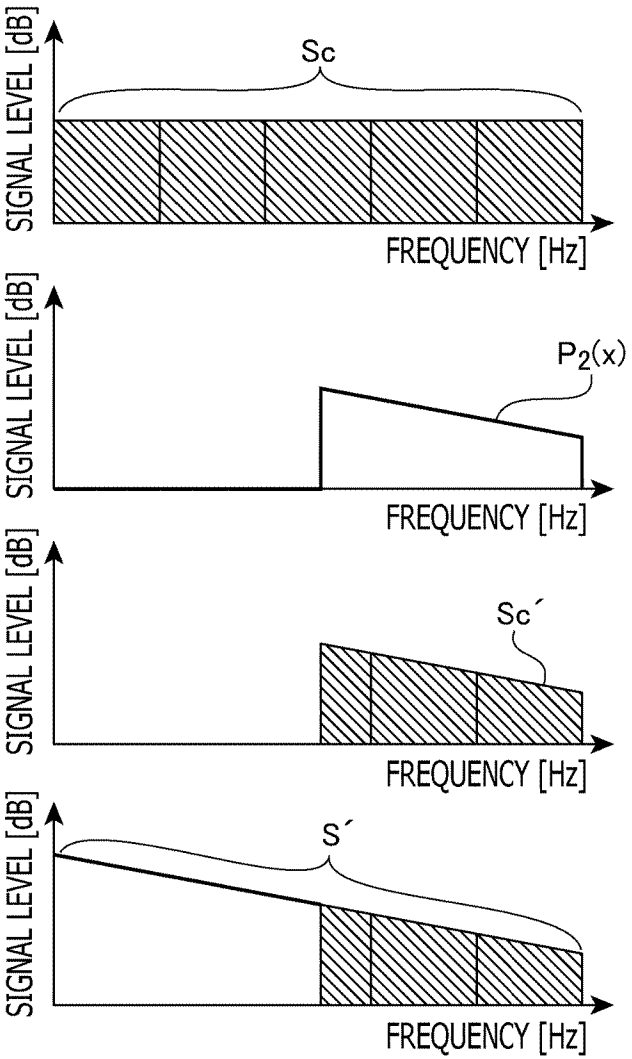

As shown in FIG. 4F, the weighting value $P_2(x)$ for the interpolation signal Sc at each frequency is calculated in the decibel scale. The interpolation signal correcting unit 250 converts the weighting value $P_2(x)$ from the decibel scale to the linear scale. The interpolation signal correcting unit 250 corrects the interpolation signal Sc by multiplying the weighting value $P_2(x)$ converted to the linear scale and the interpolation signal Sc (linear scale) generated by the interpolation signal generating unit 240 together. For example, as shown in FIG. 4G, a corrected interpolation signal Sc' is a signal in a frequency band above frequency b and the attenuation thereof is greater at higher frequencies.

To the adding unit 260, the interpolation signal Sc' is inputted from the interpolation signal correcting unit 250 as well as the amplitude spectrum S from the FFT unit 10. The amplitude spectrum S is an amplitude spectrum of an audio signal of which high frequency components are drastically cut, and the interpolation signal Sc' is an amplitude spectrum in a frequency region higher than a frequency band of the audio signal. The adding unit 260 generates an amplitude spectrum S' of the audio signal of which the high frequency region is interpolated by synthesizing the amplitude spectrum S and the interpolation signal Sc' (see FIG. 4H), and outputs the generated audio signal amplitude spectrum S' to the IFFT unit 30.

In the present embodiment, the reference signal Sb is extracted in accordance with the frequency band of the amplitude spectrum Sa, and the interpolation signal Sc' is generated from the reference signal Sb', obtained by correcting the extracted reference signal Sb, and synthesized with the amplitude spectrum S (audio signal). Thus, a high frequency region of an audio signal is interpolated with a spectrum having a natural characteristic of continuously attenuating with respect to the audio signal, regardless of a frequency characteristic of the audio signal inputted to the FFT unit 10 (for example, even when a frequency band of an audio signal has changed in accordance with the compression encoding format or the like, or even when an audio signal of which the level amplifies at the high frequency side is inputted). Therefore, improvement in auditory sound quality is achieved by the high frequency interpolation.

Figure 5A:
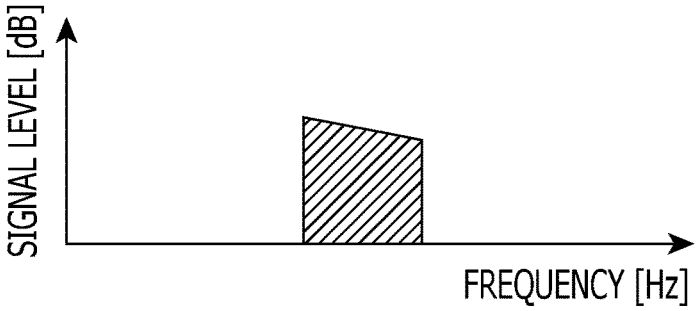
FIG. 5 shows diagrams illustrating an interpolation signal that is generated without correcting a reference signal.
Figure 5B:
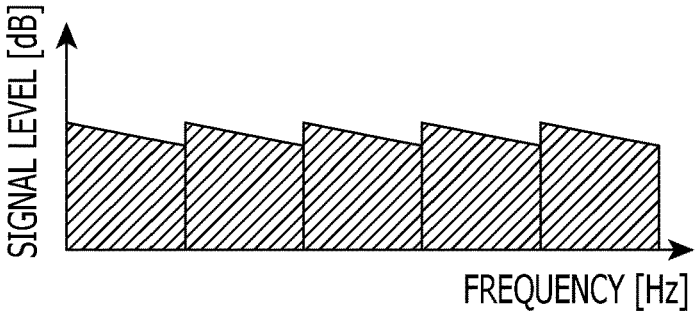
Figure 6A:
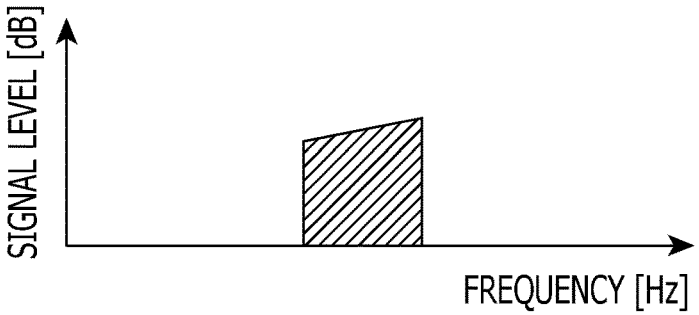
FIG. 6 shows diagrams illustrating an interpolation signal that is generated without correcting a reference signal.
Figure 6B:
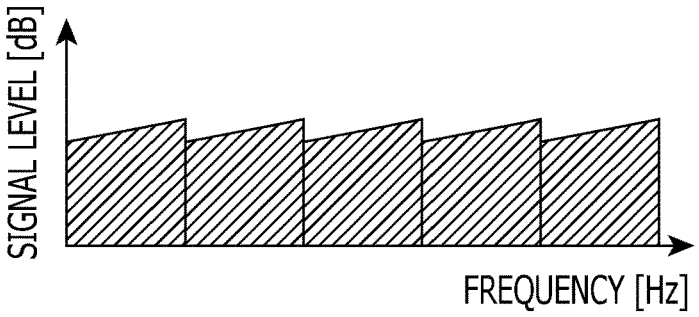

FIGS. 5 and 6 illustrate interpolation signals that are generated without correction of reference signals. In each of FIGS. 5 and 6, the vertical axis (y axis) is signal level (unit: dB), and the horizontal axis (x axis) is frequency (unit: Hz). FIG. 5 illustrates an audio signal of which the attenuation gets greater at higher frequencies, and FIG. 6 illustrates an audio signal of which the level amplifies at a high frequency region. Each of FIGS. 5A and 6A shows a reference signal extracted from the audio signal. Each of FIGS. 5B and 6B shows an interpolation signal generated by extending the extracted reference signal up to a frequency band that is higher than that of the audio signal. As each of FIGS. 5B and 6B shows, without correction of the reference signal, a spectrum of the interpolation signal becomes discontinuous. Therefore, in the examples shown in FIGS. 5 and 6, performing the high frequency interpolation on audio signals has the opposite effect of degrading auditory sound quality.

The followings are exemplary operating parameters of the sound processing device 1 of the present embodiment.

(FIT unit 10/IFFT unit 30)
sample length: 8,192 samples
window function: Hanning
overlap length: 50%
(Band Detecting Unit 210)
minimum control frequency: 7 kHz
low/middle frequency range: 2 kHz~6 kHz
high frequency range: 20 kHz~22 kHz
high frequency range level judgement: −20 dB
signal level difference: 20 dB
threshold: 0.5
(Reference Signal Extracting Unit 220)
reference band width: 2.756 kHz
(Interpolation Signal Correcting Unit 250)
lower frequency limit: 500 Hz
correction coefficient k: 0.01

"Minimum control frequency (=7 kHz)" means that the high frequency interpolation is not performed if the amplitude spectrum Sa detected by the band detecting unit 210 is less than 7 kHz. "High frequency range level judgement (=−20 dB)" means that the high frequency interpolation is not performed if the signal level at the high frequency range is equal to or more than −20 dB. "signal level difference (=20 dB)" means that the high frequency interpolation is not performed if a signal level difference between the high low/middle frequency range and the high frequency range is equal to or less than 20 dB. "Threshold (=0.5)" means that a threshold for detecting the amplitude spectrum Sa is an intermediate value between a signal level (average value) of the low/middle frequency range and a signal level (average value) of the high frequency range. "Reference band width (=2.756 kHz)" is a band width of the reference signal Sb, corresponding to the "minimum control frequency (=7 kHz)." "Lower frequency limit (=500 Hz)" indicates a lower limit of the range of the regression analysis by the interpolation signal correcting unit 250 (that is, frequencies below 500 Hz are not included in the range of the regression analysis).

Figure 7A:
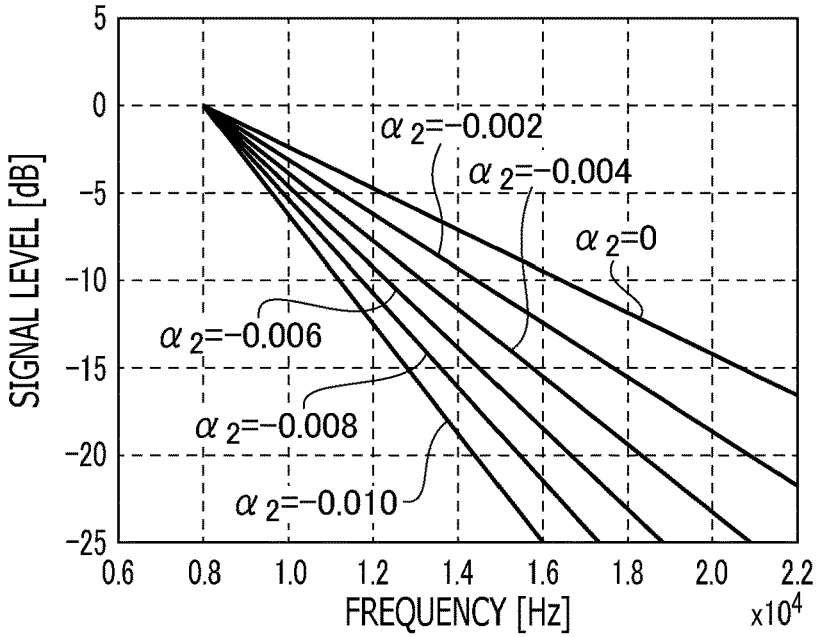
FIG. 7 shows diagrams showing relationships between a weighting value $P_2(x)$ and various parameters.
Figure 7B:
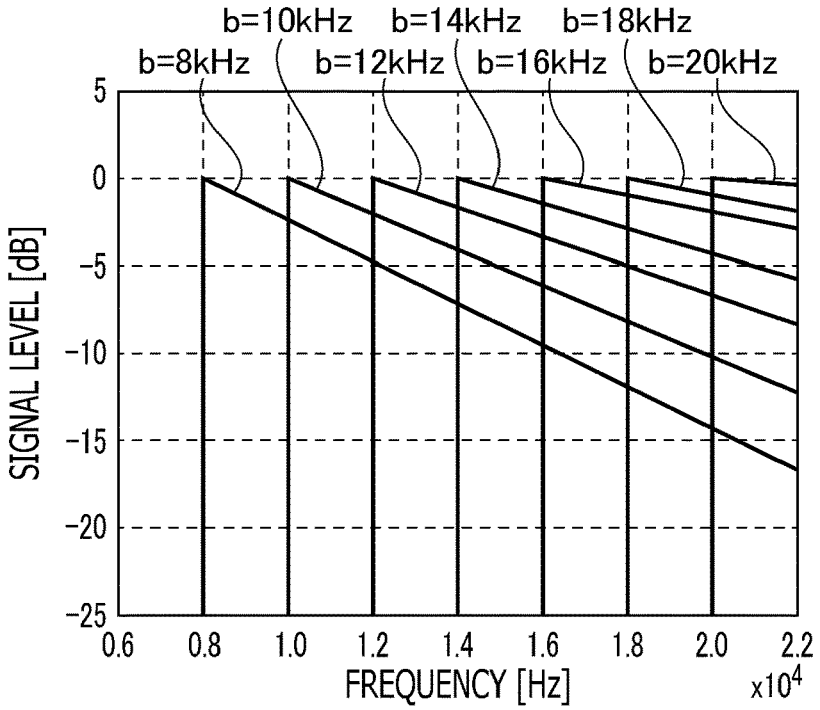

FIG. 7A shows the weighting values $P_2(x)$ when, with the above exemplary operating parameters, the frequency b is fixed at 8 kHz and the frequency slope $\alpha_2$ is changed within the range of 0 to −0.010 at −0.002 intervals. FIG. 7B shows the weighting values $P_2(x)$ when, with the above exemplary operating parameters, the frequency slope $\alpha_2$ is fixed at 0 (flat frequency characteristic) and the frequency b is changed within the range of 8 kHz to 20 kHz at 2 kHz intervals. In each of FIG. 7A and FIG. 7B, the vertical axis (y axis) is signal level (unit: dB), and the horizontal axis (x axis) is frequency (unit: Hz). It is noted that, in the examples shown in FIG. 7A and FIG. 7B, the FFT sample positions are converted to frequency.

Referring to FIG. 7A and FIG. 7B, it can be understood that the weighting value $P_2(x)$ changes in accordance with the frequency slope $\alpha_2$ and the frequency b. Specifically, as shown in FIG. 7A, the weighting value $P_2(x)$ gets greater as the frequency slope $\alpha_2$ gets greater in the minus direction (that is, the weighting value $P_2(x)$ is greater for an audio signal of which the attenuation is greater at higher frequencies), and the attenuation of the interpolation signal Sc' at a high frequency region becomes greater. Also, as shown in FIG. 7B, the weighting value $P_2(x)$ gets smaller as the frequency b becomes greater, and the attenuation of the interpolation signal Sc' at a high frequency region becomes smaller. Thus, a high frequency region of an audio signal near or exceeding the upper limit of the audible range is interpolated with a spectrum having a natural characteristic of continuously attenuating with respect to the audio signal, by changing the slope of the interpolation signal Sc' in accordance with the frequency slope of the audio signal or the range of the regression analysis. Therefore, improvement in auditory sound quality is achieved by the high frequency interpolation. Also, since the frequency band of the reference signal gets narrower as the frequency band of the audio signal becomes narrower, extraction of the voice band, causing degradation of sound quality, can be suppressed. Furthermore, since the level of the interpolation signal gets smaller as the frequency band of the audio signal gets narrower, an excessive interpolation signal is not synthesized to, for example, an audio signal having a narrow frequency band.

Figure 8A:
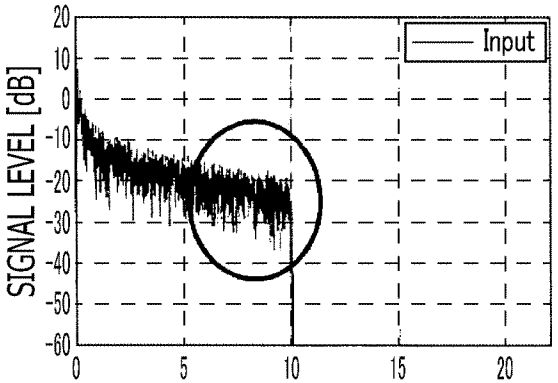
FIG. 8 shows diagrams illustrating audio signals after the high frequency interpolation, generated under operating conditions that are different from each other.

FIG. 8A shows an audio signal (frequency band: 10 kHz) of which the attenuation is greater at higher frequencies. Each of FIGS. 8B to 8E shows a signal that can be obtained by interpolating a high frequency region of the audio signal shown in FIG. 8A using the above exemplary operating parameters. It is noted that the operating conditions for FIGS. 8B to 8E differ from each other. In each of FIGS. 8A to 8E, the vertical axis (y axis) is signal level (unit: dB), and the horizontal axis (x axis) is frequency (unit: Hz).

Figure 8B:
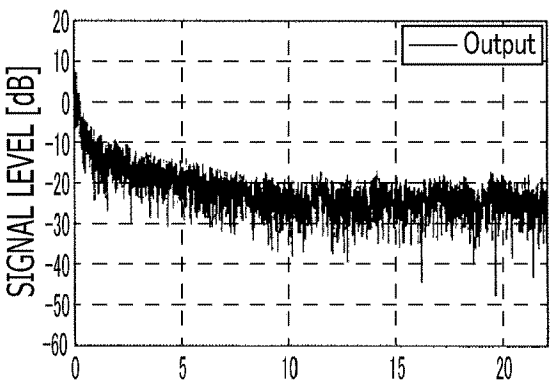
Figure 8C:
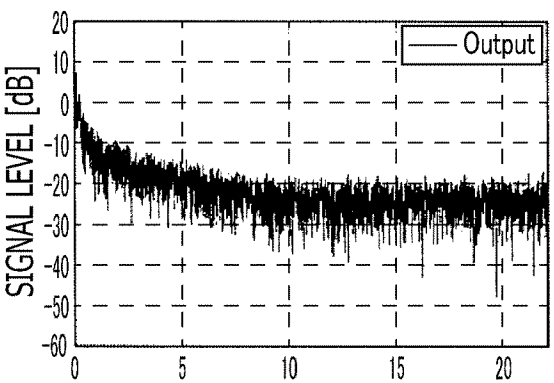

FIG. 8B shows an example in which the correction of the reference signal and the correction of the interpolation signal are omitted from the high frequency interpolation process. Also, FIG. 8C shows an example in which the correction of the interpolation signal is omitted from the high frequency interpolation process. In the examples shown in FIG. 8B and FIG. 8C, an interpolation signal having a flat frequency characteristic is synthesized to the audio signal shown in FIG. 8A. In the examples shown in FIG. 8B and FIG. 8C, since the frequency balance is lost due to the interpolation of excessive high frequency components, auditory sound quality degrades.

Figure 8D:
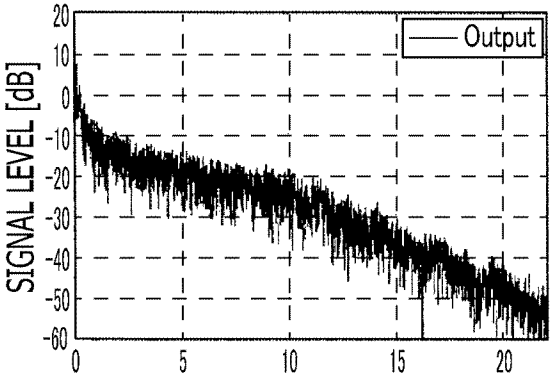
Figure 8E:
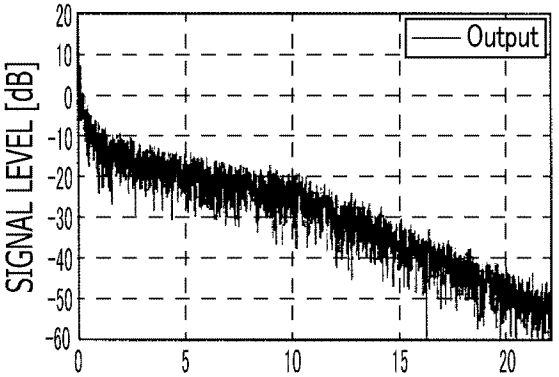

FIG. 8D shows an example in which the correction of the reference signal is omitted from the high frequency interpolation process. Also, FIG. 8E shows an example in which none of the processes are omitted from the high frequency interpolation process. In the example shown in FIG. 8D, the audio signal after the high frequency interpolation has a characteristic that the attenuation is greater at higher frequencies, but it cannot be said that the spectrum is continuously attenuating. In the example shown in FIG. 8D, it is likely that discontinuous regions remaining in the spectrum gives uncomfortable auditory feeling to users. In contrast, in the example shown in FIG. 8E, the audio signal after the high frequency interpolation has a natural spectrum characteristic where the level of the spectrum attenuates continuously and the attenuation gets greater at higher frequencies. Comparing FIG. 8D and FIG. 8E, it can be understood that the improvement in auditory sound quality by the high frequency interpolation is achieved by performing not only the correction of the interpolation signal but also the correction of the reference signal.

Figure 9A:
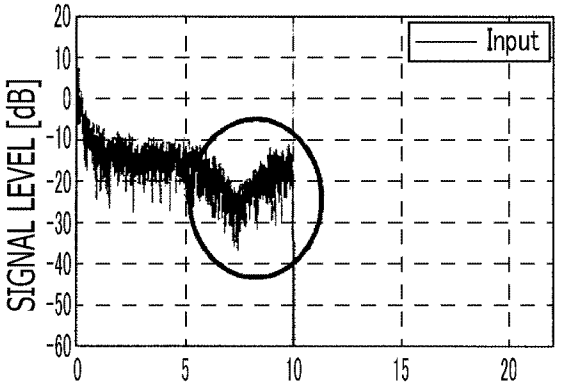
FIG. 9 shows diagrams illustrating audio signals after the high frequency interpolation, generated under operating conditions that are different from each other.

FIG. 9A shows an audio signal (frequency band: 10 kHz) of which the signal level amplifies at a high frequency region. Each of FIGS. 9B to 9E shows a signal that can be obtained by interpolating a high frequency region of the audio signal shown in FIG. 9A using the above exemplary operating parameters. The operating conditions for FIGS. 9B to 9E are the same as those for FIGS. 8B to 8E, respectively.

Figure 9B:
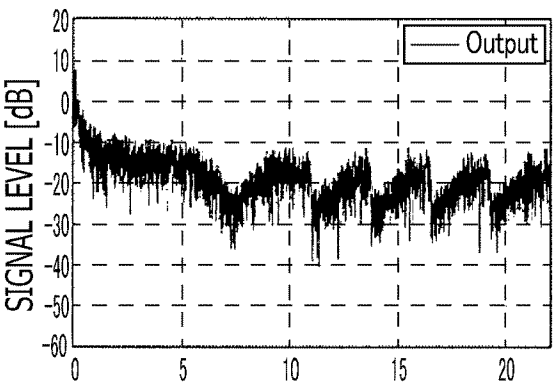
Figure 9C:
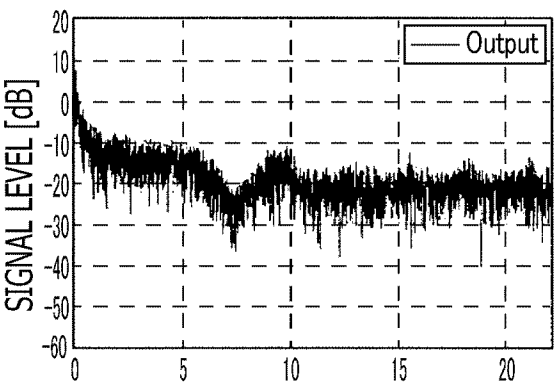

In the example shown in FIG. 9B, an interpolation signal having a discontinuous spectrum is synthesized to the audio signal shown in FIG. 9A. In the example shown in FIG. 9C, an interpolation signal having a flat frequency characteristic is synthesized to the audio signal shown in FIG. 9A. In the examples shown in FIG. 9B and FIG. 9C, since the frequency balance is lost due to the synthesis of the interpolation signal having the discontinuous characteristic or due to the interpolation of excessive high frequency components, auditory sound quality degrades.

Figure 9D:
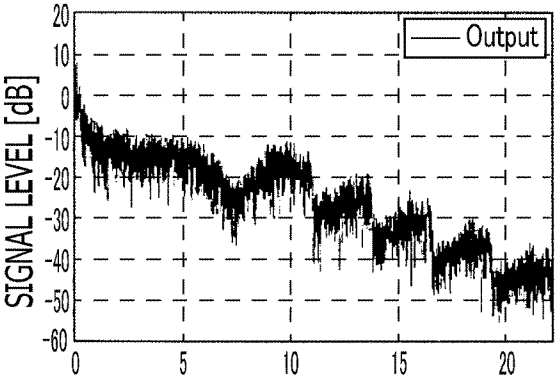
Figure 9E:
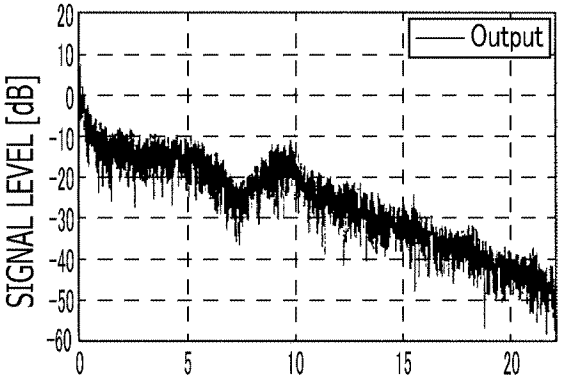

In the example shown in in FIG. 9D, the attenuation of the audio signal after the high frequency interpolation is greater at higher frequencies, but the change of the spectrum is discontinuous. In the example shown in FIG. 9D, it is likely that the discontinuous regions give uncomfortable auditory feeling to users. In contrast, in the example shown in FIG. 9E, the audio signal after the high frequency interpolation has a natural spectrum characteristic where the level of the spectrum attenuates continuously and the attenuation gets greater at higher frequencies. Comparing FIG. 9D and FIG. 9E, it can be understood that the improvement in auditory sound quality by the high frequency interpolation is achieved by performing not only the correction of the interpolation signal but also the correction of the reference signal.

The above is the description of the illustrative embodiment of the present invention. Embodiments of the present invention are not limited to the above explained embodiment, and various modifications are possible within the scope of the technical concept of the present invention. For example, appropriate combinations of the exemplary embodiment specified in the specification and/or exemplary embodiments that are obvious from the specification are also included in the embodiments of the present invention. For example, in the present embodiment, the reference signal correcting unit 230 uses linear regression analysis to correct the reference signal Sb of which the level uniformly amplifies or attenuates within a frequency band. However, the characteristic of the reference signal Sb is not limited to the linear one, and in some cases, it may be nonlinear. In case of the correction of the reference signal Sb of which the signal level repeatedly amplifies and attenuates within a frequency band, the reference signal correcting unit 230 calculates the inverse characteristic using regression analysis of increased degree, and corrects the reference signal Sb using the calculated inverse characteristic.

What is claimed is:

1. A signal processing device, comprising:

a band detecting unit configured to detect a frequency band which satisfies a predetermined condition from an audio signal;

an extracting unit configured to generate a reference signal in accordance with the detected frequency band by the band detecting unit;

a reference signal correcting unit configured to correct the generated reference signal on a basis of a frequency characteristic of the generated reference signal;

a frequency band extending unit configured to extend the corrected reference signal up to a frequency band higher than the detected frequency band;

an interpolation signal generating unit configured to generate an interpolation signal by weighting each frequency component within the extended frequency band in accordance with a frequency characteristic of the audio signal;

an adder unit configured to synthesize the generated interpolation signal with the audio signal, wherein the interpolation signal generating unit: (i) performs a first regression analysis on at least a portion of the audio signal; (ii) calculates an interpolation signal weighting value for each frequency component within the extended frequency band on a basis of a slope of at least a portion of the audio signal obtained by the first regression analysis; and (iii) generates the interpolation signal by multiplying the calculated interpolation signal weighting value for each frequency component and each frequency component within the extended frequency band together; and wherein the slope of at least the portion of the audio signal obtained by the first regression analysis includes a rate of change of the frequency components within the extended frequency band; and wherein the interpolation signal generating unit increases the interpolation signal weighting value as the rate of change gets greater in a minus direction.

2. The signal processing device according to claim 1, wherein the reference signal correcting unit corrects the reference signal generated by the extracting unit to a flat frequency characteristic.

3. The signal processing device according to claim 1, wherein the reference signal correcting unit:

performs a second regression on the reference signal generated by the extracting unit;

calculates a reference signal weighting value for each frequency of the reference signal on a basis of frequency characteristic information obtained by the second regression analysis; and corrects the reference signal by multiplying the calculated reference signal weighting value for each frequency and the reference signal together.

4. The signal processing device according to claim 1, wherein the extracting unit extracts a range that is within n % of the overall detected frequency band at a high frequency side and sets the extracted components as the reference signal.

5. The signal processing device according to claim 1, wherein the band detecting unit:

calculates levels of the audio signal in a first frequency range and a second frequency range being higher than the first frequency range;

sets a threshold on a basis of the calculated levels in the first and second frequency ranges; and detects the frequency band from the audio signal on a basis of the set threshold.

6. The signal processing device according to claim 5, wherein the band detecting unit detects, from the audio signal, a frequency band of which an upper frequency limit is a highest frequency point among at least one frequency point where the level falls below the threshold.

7. The signal processing device according to claim 1, wherein the interpolation signal generating unit decreases the interpolation signal weighting value as an upper frequency limit of a range for the first regression analysis gets higher.

8. The signal processing device according to claim 5, wherein when at least one of following conditions (1) to (3) is satisfied, the signal processing device does not perform generation of the interpolation signal by the interpolation signal generating unit:

(1) the detected amplitude spectrum Sa is equal to or less than a predetermined frequency range;

(2) the signal level at the second frequency range is equal to or more than a predetermined value; or (3) a signal level difference between the first frequency range and the second frequency range is equal to or less than a predetermined value.

9. A signal processing method, comprising:

detecting a frequency band which satisfies a predetermined condition from an audio signal;

generating a reference signal in accordance with the detected frequency band;

correcting the generated reference signal on a basis of a frequency characteristic of the generated reference signal;

extending the corrected reference signal up to a frequency band higher than the detected frequency band;

generating an interpolation signal by weighting each frequency component within the extended frequency band in accordance with a frequency characteristic of the audio signal; and synthesizing the generated interpolation signal with the audio signal, wherein in the generating interpolation signal: (i) a first regression analysis is performed on at least a portion of the audio signal; (ii) an interpolation signal weighting value is calculated for each frequency component within the extended frequency band on a basis of a slope of at least a portion of the audio signal obtained by the first regression analysis; and (iii) the interpolation signal is generated by multiplying the calculated interpolation signal weighting value for each frequency component and each frequency component within the extended frequency band together;

wherein the slope of at least the portion of the audio signal obtained by the first regression analysis includes a rate of change of the frequency components within the extended frequency band, and wherein in the generating the interpolation signal, the interpolation signal weighting value is increased as the rate of change gets greater in a minus direction.

10. The signal processing method according to claim 9, wherein in the correcting the generated reference signal, the generated reference signal is corrected to a flat frequency characteristic.

11. The signal processing method according to claim 9, wherein in the correcting the generated reference signal:

a second regression analysis is performed on the generated reference signal for obtaining a slope of a reference signal;

a reference signal weighting value is calculated for each frequency of the reference signal on a basis of frequency characteristic information obtained by the second regression analysis; and the generated reference signal is corrected by multiplying the calculated reference signal weighting value for each frequency and the reference signal together.

12. The signal processing method according to claim 9, wherein in the generating the reference signal, a range that is within n % of the overall detected frequency band at a high frequency side are extracted, and the extracted components are set as the reference signal.

13. The signal processing method according to claim 9, wherein in the detecting the frequency band:

levels of the audio signal in a first frequency range and a second frequency range being higher in frequency than the first frequency range are calculated;

a threshold is set on a basis of the calculated levels in the first and second frequency ranges; and the frequency band is detected from the audio signal on a basis of the set threshold.

14. The signal processing method according to claim 13, wherein in the detecting the frequency band, a frequency band of which an upper frequency limit is a highest frequency point among at least one frequency point where the level falls below the threshold is detected from the audio signal.

15. The signal processing method according to claim 9, wherein in the generating the interpolation signal, the interpolation signal weighting value is decreased as an upper frequency limit of a range for the first regression analysis gets higher.

16. The signal processing method according to claim 13, wherein when at least one of following conditions (1) to (3) is satisfied, generation of the interpolation signal is not performed in the generating the interpolation signal:

(1) the detected amplitude spectrum Sa is equal to or less than a predetermined frequency range;

(2) the signal level at the second frequency range is equal to or more than a predetermined value; or (3) a signal level difference between the first frequency range and the second frequency range is equal to or less than a predetermined value.

17. A signal processing device, comprising:

a band detecting unit configured to detect a frequency band which satisfies a predetermined condition from an audio signal;

an extracting unit configured to generate a reference signal in accordance with the detected frequency band by the band detecting unit;

a reference signal correcting unit configured to correct the generated reference signal on a basis of a frequency characteristic of the generated reference signal;

a frequency band extending unit configured to extend the corrected reference signal up to a frequency band higher than the detected frequency band;

an interpolation signal generating unit configured to generate an interpolation signal by weighting each frequency component within the extended frequency band in accordance with a frequency characteristic of the audio signal;

an adder unit configured to synthesize the generated interpolation signal with the audio signal;

wherein the interpolation signal generating unit: (i) performs a first regression analysis on at least a portion of the audio signal; (ii) calculates an interpolation signal weighting value for each frequency component within the extended frequency band on a basis of a slope of at least a portion of the audio signal obtained by the first regression analysis; and (iii) generates the interpolation signal by multiplying the calculated interpolation signal weighting value for each frequency component and each frequency component within the extended frequency band together; and wherein the interpolation signal generating unit decreases the interpolation signal weighting value as an upper frequency limit of a range for the first regression analysis gets higher.

18. A signal processing method, comprising:

detecting a frequency band which satisfies a predetermined condition from an audio signal;

generating a reference signal in accordance with the detected frequency band;

correcting the generated reference signal on a basis of a frequency characteristic of the generated reference signal;

extending the corrected reference signal up to a frequency band higher than the detected frequency band;

generating an interpolation signal by weighting each frequency component within the extended frequency band in accordance with a frequency characteristic of the audio signal; and synthesizing the generated interpolation signal with the audio signal;

wherein in the generating interpolation signal: (i) a first regression analysis is performed on at least a portion of the audio signal; (ii) an interpolation signal weighting value is calculated for each frequency component within the extended frequency band on a basis of a slope of at least a portion of the audio signal obtained by the first regression analysis; and (iii) the interpolation signal is generated by multiplying the calculated interpolation signal weighting value for each frequency component and each frequency component within the extended frequency band together; and wherein in the generating the interpolation signal, the interpolation signal weighting value is decreased as an upper frequency limit of a range for the first regression analysis gets higher.

* * * * *